US007212176B2

(12) United States Patent
Kim

(10) Patent No.: US 7,212,176 B2
(45) Date of Patent: May 1, 2007

(54) PLASMA DISPLAY AND DRIVING METHOD THEREOF

(75) Inventor: Joon-Yeon Kim, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 76 days.

(21) Appl. No.: 11/046,636

(22) Filed: Jan. 28, 2005

(65) Prior Publication Data

US 2005/0190122 A1 Sep. 1, 2005

(30) Foreign Application Priority Data

Jan. 30, 2004 (KR) ..... 10-2004-0005975

(51) Int. Cl.
*G09G 3/28* (2006.01)
*G09G 3/10* (2006.01)

(52) U.S. Cl. ..... 345/60; 315/169.3

(58) Field of Classification Search ..... 315/169.1, 315/169.3; 345/76, 84, 44–46, 60
See application file for complete search history.

(56) References Cited

U.S. PATENT DOCUMENTS

| | | | | |
|---|---|---|---|---|
| 6,842,159 | B2 * | 1/2005 | Kishi et al. | 345/60 |
| 6,972,963 | B1 * | 12/2005 | Chou | 361/760 |
| 2005/0093429 | A1 * | 5/2005 | Ahn et al. | 313/498 |
| 2005/0174305 | A1 * | 8/2005 | Chae et al. | 345/60 |
| 2006/0061523 | A1 * | 3/2006 | Kim et al. | 345/67 |

* cited by examiner

*Primary Examiner*—Trinh Vo Dinh
(74) *Attorney, Agent, or Firm*—Christie, Parker & Hale, LLP

(57) ABSTRACT

A plasma display includes a plasma display having a plurality of X electrodes and Y electrodes arranged alternately, and a plurality of M electrodes respectively formed between the X and Y electrodes, and a plurality of insulated address electrodes crossing the X, Y, and M electrodes. A common coupling line is formed on the plasma display panel and is coupled to a first voltage, the common coupling line coupling the X electrodes in common. A Y electrode driver applies a waveform for driving the Y electrode. An M electrode driver applies a waveform for driving the M electrode. A flexible printed circuit couples the M electrode driver and the M electrodes.

15 Claims, 14 Drawing Sheets

PLASMA DISPLAY AND DRIVING METHOD THEREOF

CROSS REFERENCE TO RELATED APPLICATION

This application claims priority to and the benefit of Korea Patent Application No. 10-2004-0005975 filed on Jan. 30, 2004 in the Korean Intellectual Property Office, the content of which is incorporated herein by reference.

BACKGROUND OF THE INVENTION (a) Field of the Invention

The present invention relates to a plasma display and a driving method thereof.

(b) Description of the Related Art

Recently, liquid crystal displays (LCDs), field emission displays (FEDs), and plasma displays have been actively developed. Among flat panel devices, plasma displays have better luminance and light emission efficiency as compared to the other types, and they also have wider view angles. Therefore, plasma displays have come into the spotlight as substitutes for conventional cathode ray tubes (CRTs) in large displays of greater than 40 inches.

A plasma display is a flat display that uses plasma generated via a gas discharge process to display characters or images, and tens to millions of pixels are provided thereon in a matrix format, depending on its size. Plasma displays are categorized into DC plasma displays and AC plasma displays, according to supplied driving voltage waveforms and discharge cell structures.

Since the DC plasma displays have electrodes exposed in the discharge space, they allow a current to flow in the discharge space while the voltage is supplied, and therefore they problematically require resistors for current restriction. On the other hand, since the AC plasma displays have electrodes covered by a dielectric layer, capacitances are naturally formed to restrict the current, and the electrodes are protected from ion shocks in the case of discharging. Accordingly, they have a longer lifespan than the DC plasma displays.

FIG. 1 shows a perspective view of an AC PDP, and FIG. 2 shows a cross-sectional view of the PDP of FIG. 1. An X electrode 3 and a Y electrode 4, disposed over a dielectric layer 14 and a protection film 15, are provided in parallel and form a pair with each other under a first glass substrate 11. The X and Y electrodes are made of transparent conductive material, and bus electrodes 6 made of metal are respectively formed on the surfaces of the X and Y electrodes 3 and 4.

A plurality of address electrodes 5 covered with a dielectric layer 14' are installed on a second glass substrate 12. Barrier ribs 17 are formed in parallel with address electrodes 5, on dielectric layer 14' in between address electrodes 5, and phosphor 18 is formed on the surface of dielectric layer 14' and on both sides of barrier ribs 17. First and second glass substrates 11 and 12 having a discharge space 19 between them are provided facing each other so that Y electrode 4 and X electrode 3 may cross address electrode 5. Address electrode 5 and a discharge space 19 formed at a crossing part of Y electrode 4 and X electrode 3 form a discharge cell 20.

FIG. 3 shows a conventional plasma display electrode arrangement diagram. The plasma display electrode has an m×n matrix configuration, with address electrodes A1 to Am in a column direction, and Y electrodes Y1 to Yn and X electrodes X1 to Xn in a row direction, alternately. Discharge cell 20 shown in FIG. 3 corresponds to the discharge cell 20 shown in FIG. 1.

FIG. 4 shows a conventional plasma display driving waveform diagram. Each subfield includes a reset period, an address period, and a sustain discharge period. The reset period erases wall charge states of a previous sustain discharge, and sets up the wall charges in order to stably perform a next address. In the addressing period, the cells that are turned on and the cells that are not turned on in a panel are selected, and wall charges are accumulated to the cells that are turned on (i.e., the addressed cells). In the sustain discharge period, discharge for actually displaying pictures on the addressed cells is performed by alternately applying sustain discharge voltages to the X and Y electrodes.

The operation of the conventional plasma display driving method during the reset period will now be described in more detail. As shown in FIG. 4, the reset period includes an erase period, a Y ramp rising period, and a Y ramp falling period.

(1) Erase Period ($^{I}$)

During this period, a falling ramp that gently falls from a sustain discharge voltage Vs to a ground potential (0V) is applied to the Y electrode while the X electrode is biased with a constant potential Vbias, thereby eliminating the wall charges formed in the previous sustain discharge period.

(2) Y Ramp Rising Period ($^{II}$)

During this period, the address electrode and the X electrode are maintained at 0V, and a ramp voltage gradually rising from voltage Vs to voltage Vset is applied to the Y electrode. While the ramp voltage rises, weak resetting is generated to all the discharge cells from the Y electrode to the address electrode and the X electrode. As a result, the negative wall charges are accumulated to the Y electrode, and concurrently, the positive wall charges are accumulated to the address electrode and the X electrode.

(3) Y Ramp Falling Period ($^{III}$)

In the latter part of the reset period, a ramp voltage that gradually falls from voltage Vs to the ground potential is applied to the Y electrode under the state that the X electrode maintains constant voltage Vbias. While the ramp voltage falls, weak resetting is generated again at all the discharge cells.

However, the sustain discharge operation is concurrently performed on all the discharge cells in the conventional plasma display after the address operation, from the first Y electrode to the last Y electrode, is complete. Therefore, since insufficient priming particles are generated in the discharge cells when a first sustain discharge pulse is applied after an address period in the conventional plasma display, bad discharge is generated.

Also, since the waveform applied to the Y electrode (to which waveforms for resetting and scanning are additionally applied) during the reset period is different from the waveform applied to the X electrode in the conventional plasma display, the circuit for driving the Y electrode is different from the circuit for driving the X electrode. Accordingly, no impedance matching on the driving circuits of the X and Y electrodes is performed, the waveforms alternately applied to the X and Y electrodes in the sustain discharge period are distorted, and bad discharges occur.

SUMMARY OF THE INVENTION

In accordance with the present invention a plasma display for preventing bad discharges, and a driving method thereof, is provided. A plasma display with a simple circuit structure, and a driving method thereof, is also provided.

In one aspect of the present invention, a method is provided for driving a plasma display having a plurality of first electrodes and second electrodes arranged alternately, and a plurality of third electrodes, each third electrode being formed between a respective first electrode and second electrode. The first electrodes are coupled through a common coupling line, and the third electrodes are coupled to a driver through a flexible printed circuit. The method includes, in a sustain discharge period, (a) biasing each first electrode with a first voltage through the common coupling line; (b) alternately applying a second voltage which is greater than the first voltage and a third voltage which is less than the first voltage to each second electrode; and (c) applying a fourth voltage which is greater than the first voltage to each third electrode while the second voltage is applied to the second electrode, and applying a fifth voltage which is less than the first voltage to each third electrode while the third voltage is applied to the second electrode.

In another aspect of the present invention, a plasma display includes: a plasma display panel having a plurality of X electrodes and Y electrodes arranged alternately, and a plurality of M electrodes, each M electrode being formed between respective X and Y electrodes, and a plurality of insulated address electrodes, each address electrode crossing a respective X, Y, and M electrode; a common coupling line formed on the plasma display panel and coupled to a first voltage, the common coupling line for coupling the X electrodes in common; a Y electrode driver for applying a waveform for driving the Y electrode; an M electrode driver for applying a waveform for driving the M electrode; and a flexible printed circuit for coupling the M electrode driver and the M electrodes.

DETAILED DESCRIPTION

Figure 1:
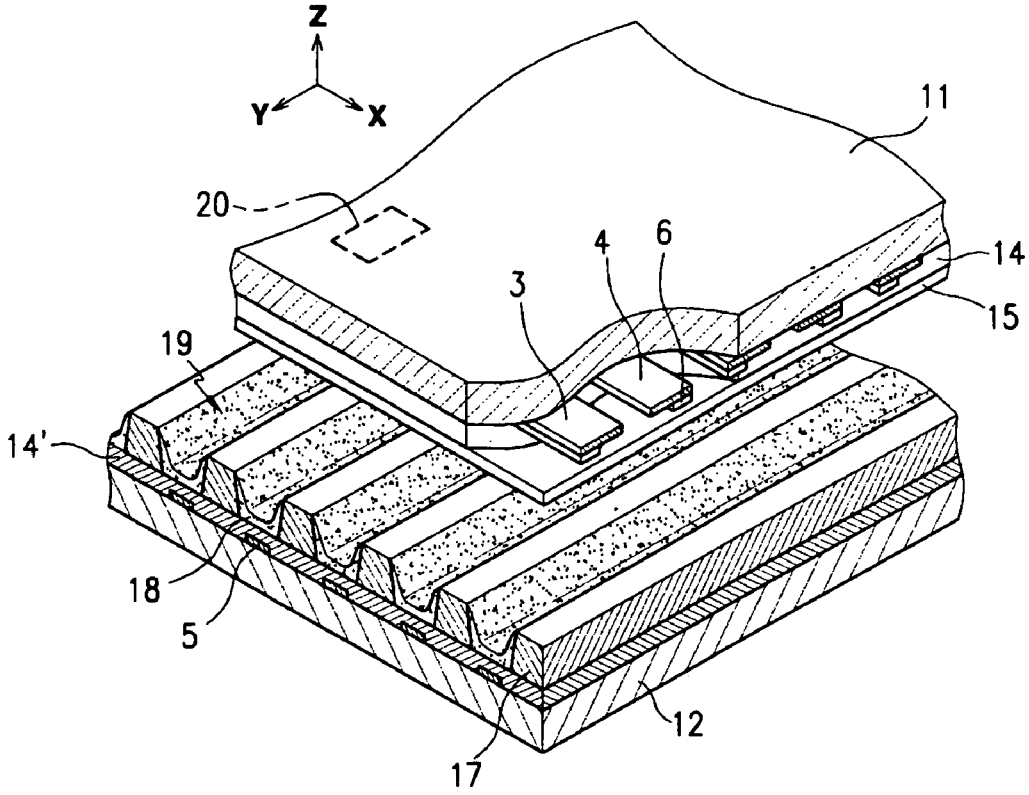
FIG.1 (Prior Art)
FIG. 1 shows a perspective view of a conventional PDP.
Figure 2:
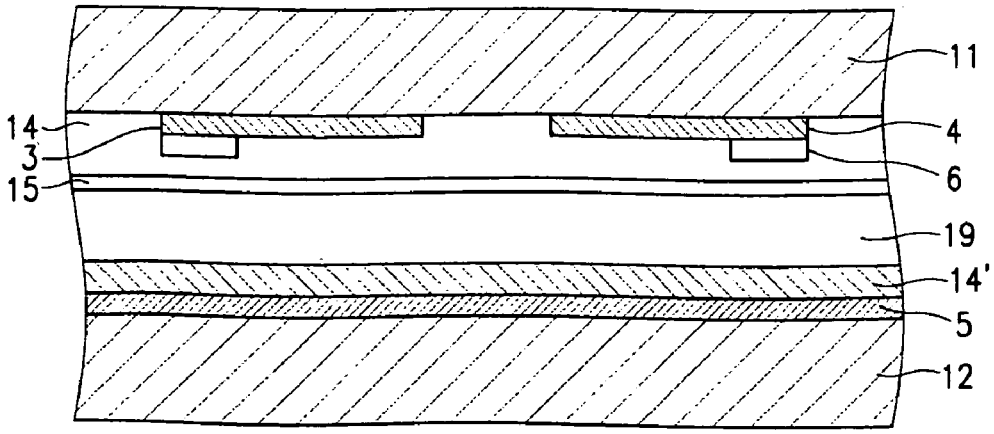
FIG.2 (Prior Art)
FIG. 2 shows a cross-sectional view of the PDP of FIG. 1.
Figure 3:
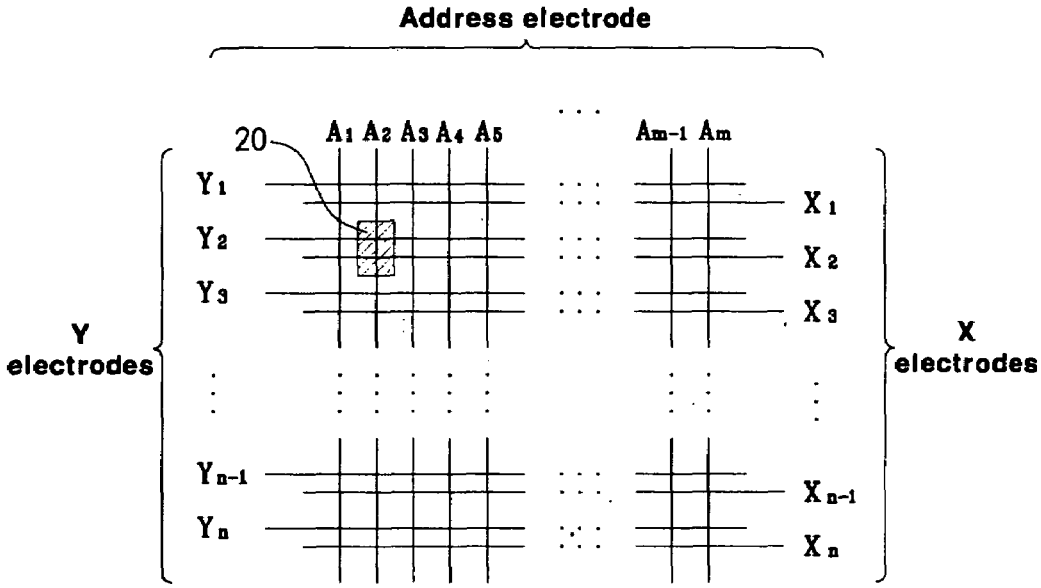
FIG.3 (Prior Art)
FIG. 3 shows a conventional electrode arrangement diagram of a plasma display.
Figure 4:
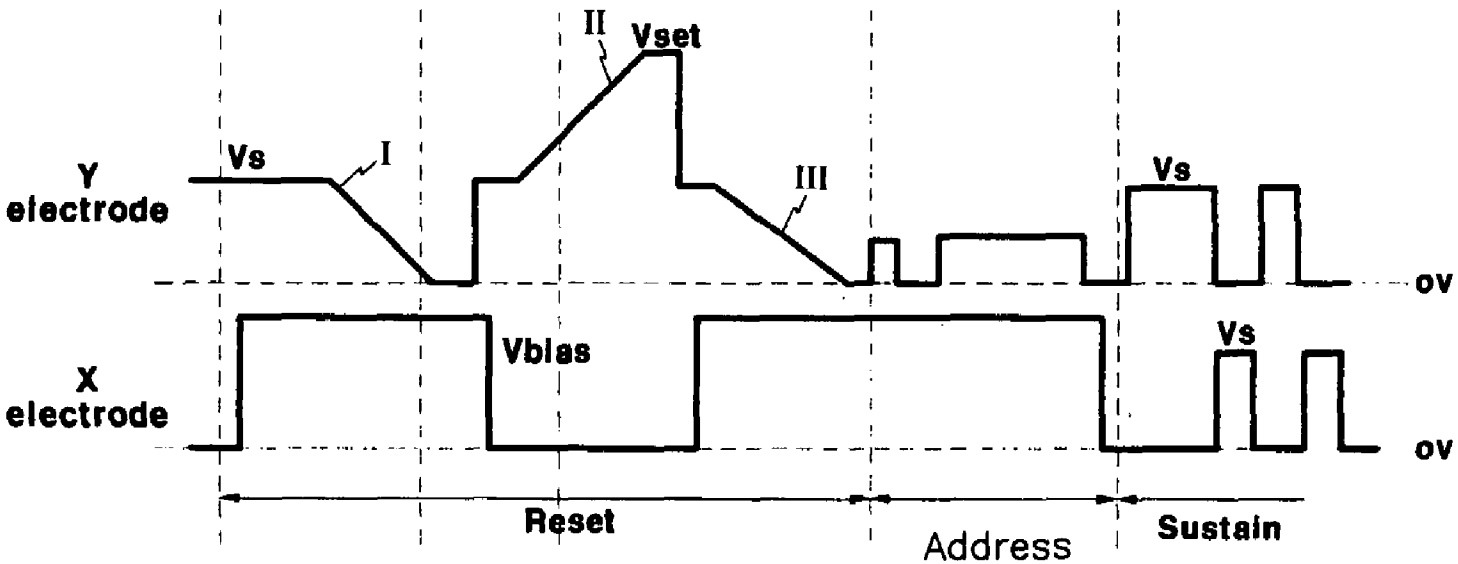
FIG.4 (Prior Art)
FIG. 4 shows a conventional plasma display driving waveform diagram.
Figure 5:
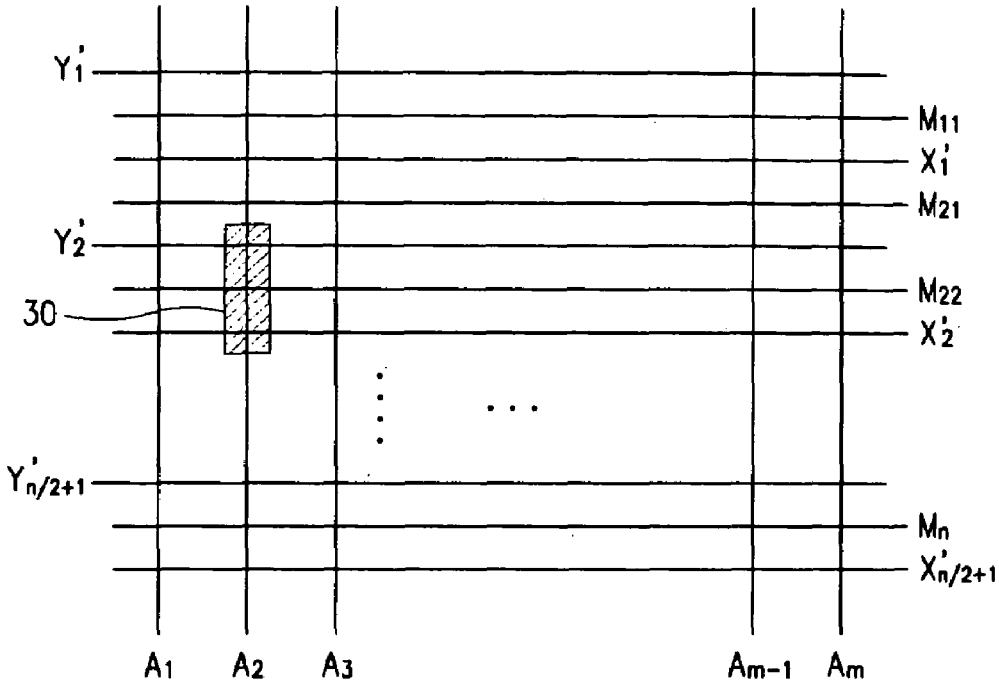
FIG. 5 shows a plasma display electrode arrangement diagram according to an exemplary embodiment of the present invention.

Referring now to FIG. 5, address electrodes A1 to Am are provided in parallel in a column direction, and (n/2+1) Y electrodes Y1' to Yn/2+1', (n/2+1) X electrodes X1' to Xn/2+1', and n median electrodes (referred to as M electrodes hereinafter) are provided in a row direction. That is, the M electrodes are provided between the Y and X electrodes, and the Y electrode, the X electrode, the M electrode, and the address electrode form single discharge cell 30 to thus configure a four-electrode structure.

The X and Y electrodes function as electrodes for applying sustain discharge voltage waveforms, and the M electrodes function as electrodes for applying reset waveforms and scan pulse voltages.

Figure 6:
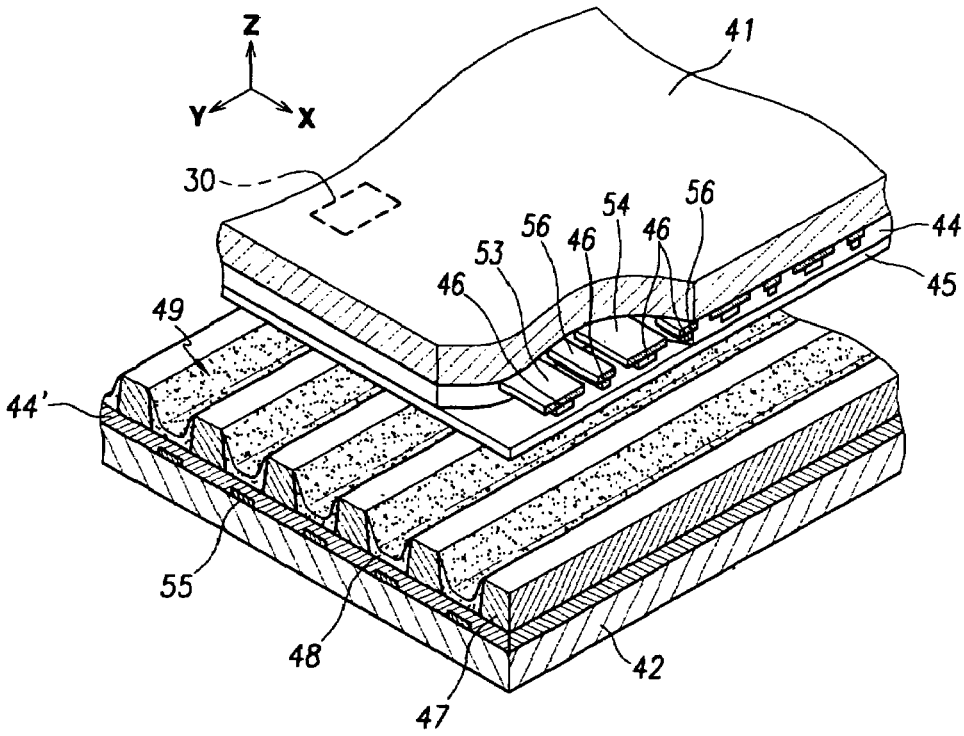
FIGS. 6 and 7 respectively show a perspective view and a cross-sectional view of the PDP according to an exemplary embodiment of the present invention.
Figure 7:
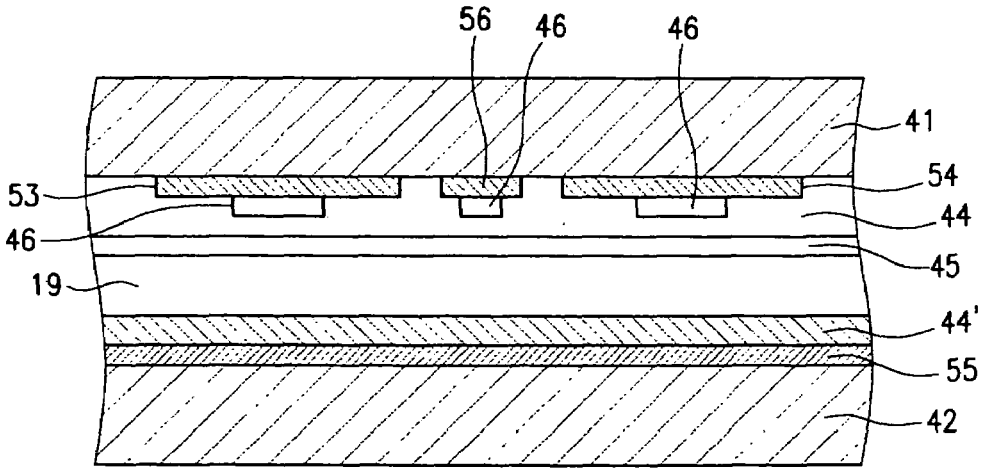

FIG. 6 shows a perspective view of the PDP according to an exemplary embodiment of the present invention, and FIG. 7 shows a cross-sectional view of the PDP shown in FIG. 6. The plasma display panel includes a first substrate 41 and a second substrate 42. An X electrode 53 and a Y electrode 54 are formed on the first substrate 41. A bus electrode 46 is formed on the X and Y electrodes 53 and 54. A dielectric layer 44 and a protection film 45 are sequentially formed on the X and Y electrodes 53, 54.

Address electrodes 55 are formed on the surface of the second substrate 42, and a dielectric layer 44' is formed on the address electrodes 55. Barrier ribs 47 are formed on the dielectric layer 44' to thereby form discharge spaces 49 between the barrier ribs 47. Phosphor 48 is coated on the surface of the barrier rib 47 in the cell space between the barrier ribs 47. The X and Y electrodes 53, 54 are formed perpendicular to the address electrode 55 and provide discharge cell 30. The discharge cell 30 in FIG. 6 is comparable to the discharge cell 30 shown in FIG. 5.

An M electrode 56 is formed between one pair of the X and Y electrodes 53 and 54 formed on the surface of the first substrate 41. A reset waveform and a scan waveform are applied to the M electrode. A bus electrode 46 is formed on the M electrode 56.

M electrodes are provided between the Xi' electrodes and the Yi' electrodes and between the Yi+1' electrodes and the Xi+1' electrodes in the plasma display panel according to the exemplary embodiment shown in FIGS. 5 to 7. That is, n M electrodes are provided when (n/2+1) X and Y electrodes are provided. However, the M electrodes 56 are provided between the Xi' electrodes 53 and the Yi' electrodes 54, and not between the Yi' electrodes and the Xi+1' electrodes. In this case, the number of the X, Y, and M electrodes is n.

Figure 8:
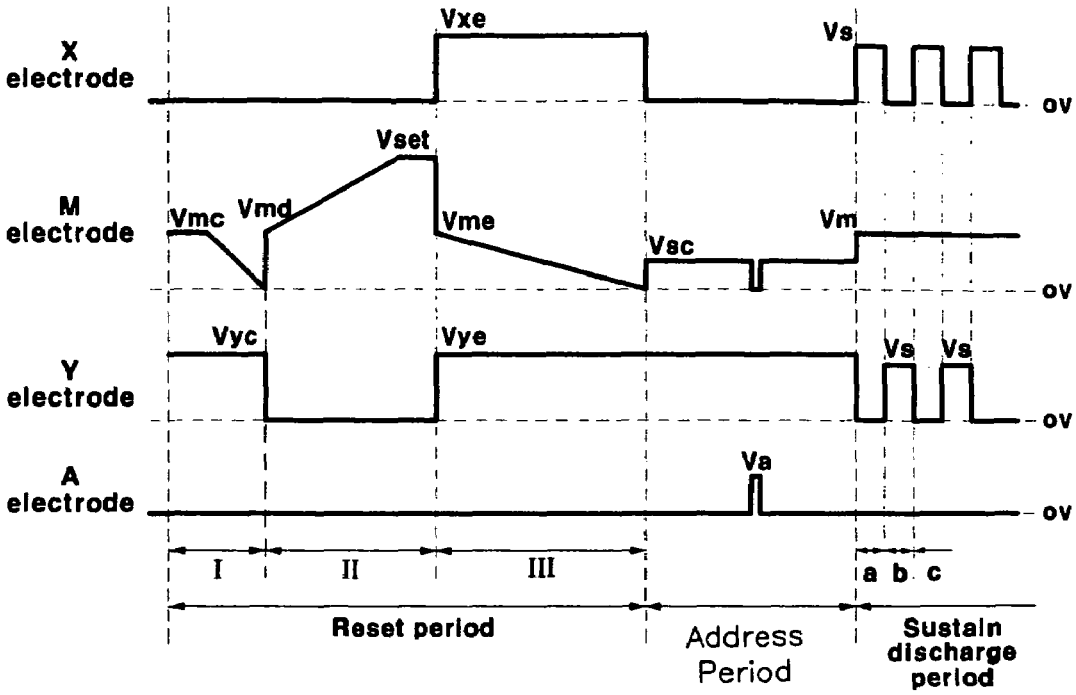
FIG. 8 shows a plasma display driving waveform diagram according to an exemplary embodiment of the present invention.

FIG. 8 shows a driving waveform diagram of a plasma display according to a first exemplary embodiment of the present invention, and FIGS. 9A to 9E show wall charge distribution diagrams based on the driving waveform of FIG. 8 according to an exemplary embodiment of the present invention.

Referring to FIGS. 8 and 9A to 9E, a driving method according to the first exemplary embodiment of the present invention will now be described.

Each subfield includes a reset period, an address period, and a sustain discharge period, and the reset period includes an erase period, an M electrode rising waveform period, and an M electrode falling waveform period.

(1-1) Erase Period ($^{I}$)

Figure 9A:
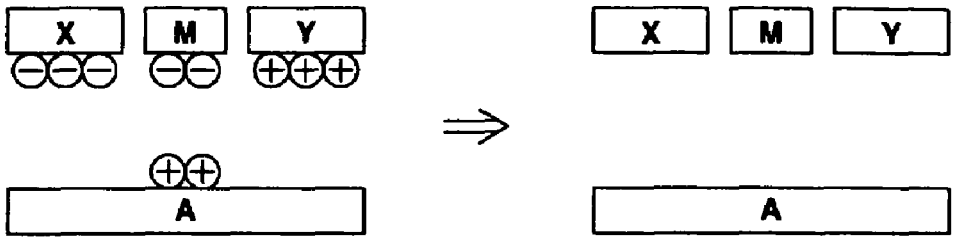
FIGS. 9A to 9E show wall charge distribution diagrams when the waveform shown in FIG. 8 is applied.

During the erase period, wall charges formed during the previous sustain discharge period are erased. It is assumed in the exemplary embodiment that a sustain discharge voltage pulse is applied to the X electrode, and a voltage (e.g., a ground voltage) lower than the voltage applied to the X electrode is applied to the Y electrode at the final time of the sustain discharge period. As a result, as shown in FIG. 9A, positive wall charges are formed at the Y and address electrodes, and negative wall charges are formed at the X and M electrodes.

During the erase period, a waveform (a ramp waveform or a logarithmic waveform) that gradually falls from the voltage of Vmc to the ground voltage is applied to the M electrode while the Y electrode is biased with the voltage of Vyc. Accordingly, the wall charges that were formed during the sustain discharge period are erased as shown in FIG. 9A.

(1-2) M Electrode Rising Waveform Period ($^{II}$)

Figure 9B:
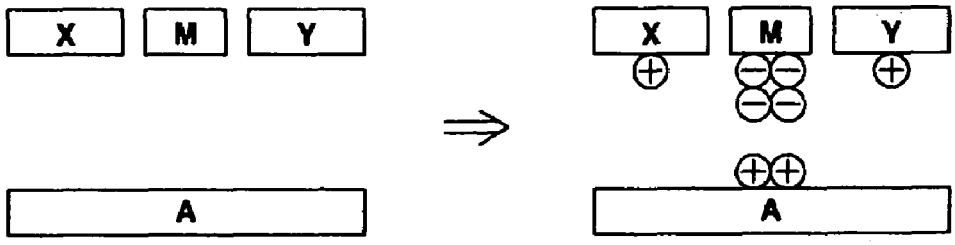

During this period, a waveform (a ramp waveform or a logarithmic waveform) that gradually rises from the voltage of Vmd to the voltage of Vset is applied to the M electrode while the X and Y electrodes are biased with the ground voltage. While the rising waveform is applied, weak resetting is generated from the M electrode to the address, X, and Y electrodes in all the discharge cells. As a result, the negative wall charges are accumulated at the M electrode, and the positive wall charges are accumulated at the address, X, and Y electrodes as shown in FIG. 9B.

(1-3) M Electrode Falling Waveform Period ($^{III}$)

During the latter part of the reset period, a waveform (a ramp waveform or a logarithmic waveform) that gradually falls from the voltage of Vme to the ground voltage is applied to the M electrode while the X and Y electrodes are respectively biased with the voltages of Vxe and Vye. In this instance, it is desirable to set the voltages as Vxe=Vye and Vmd=Vme for a simple circuit configuration, although the exemplary embodiment is not restricted to this.

Weak resetting is generated again while the ramp voltage falls. Since the M electrode falling waveform period is provided for gradually reducing the wall charges accumulated during the M electrode rising waveform period, it is advantageous to the addressing to lengthen the time of the falling waveform since the reduced wall charges can be precisely controlled as the time of the falling waveform becomes longer (i.e., as the gradient becomes gentler).

Figure 9C:
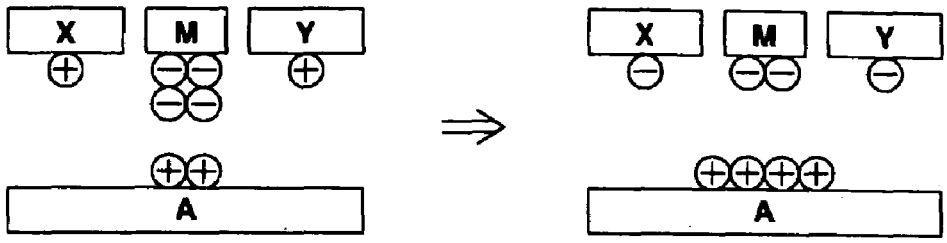

The wall charges accumulated at the respective electrodes of all the cells are uniformly erased according to the result of applying the falling waveforms to the M electrode, and accordingly, the positive wall charges are accumulated to the address electrode, and the negative wall charges are concurrently accumulated to the X, Y, and M electrodes as shown in FIG. 9C.

(2) Address Period (Scan Period)

During the address period, a scan voltage (e.g., the 0V ground voltage) is sequentially applied to the M electrode to thus apply a scan pulse, and an address voltage is applied to the address electrode to thus apply the address voltage to cells to be discharged (i.e., the cells to be turned on) while a plurality of M electrodes are biased with the voltage of Vsc. The X electrode is maintained at the ground voltage, and the voltage of Vye is applied to the Y electrode. That is, the voltage greater than the voltage at the X electrode is applied to the Y electrode.

Figure 9D:
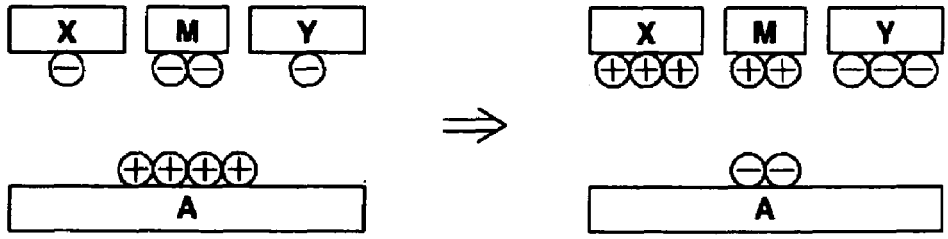

Discharges occur between the M and the address electrodes, and the discharges are extended to the X and Y electrodes, and accordingly, the positive wall charges are accumulated to the X and M electrodes, and the negative wall charges are accumulated to the Y and address electrodes, as shown in FIG. 9D.

(3) Sustain Discharge Period

During the sustain discharge period, a sustain discharge voltage pulse is alternately applied to the X and Y electrodes while the M electrode is biased with the sustain discharge voltage of Vm. The sustain discharge is generated at the discharge cells selected in the address period through the above-noted voltage application.

The discharges are generated by different discharge mechanisms at the initial sustain discharge and at the normal time. For ease of description, the discharge that is generated at the initial sustain discharge is referred to as a short-gap discharge period, and the discharge at the normal time is referred to as a long-gap discharge period.

(3-1) Short Gap Discharge Period

Figure 9E:
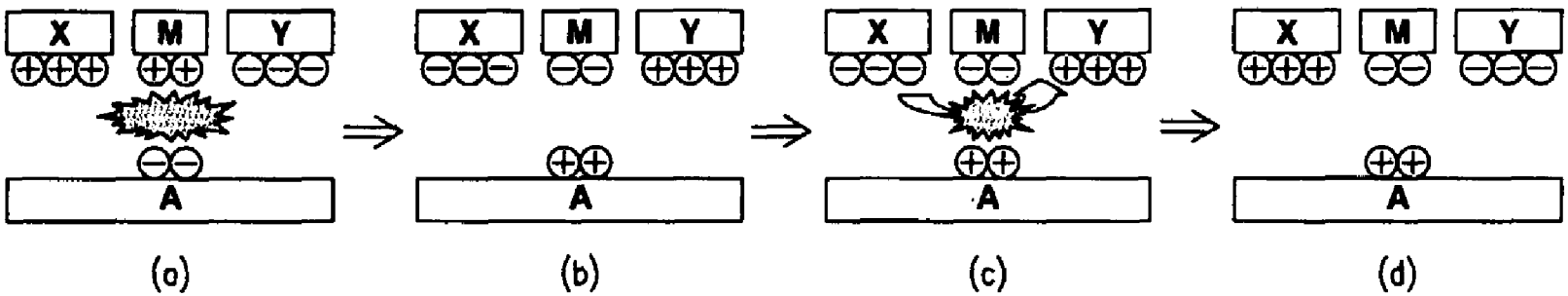

As shown in parts (a) and (b) of FIG. 9E, a positive voltage pulse is applied to the X electrode, and a negative voltage pulse is applied to the Y electrode (the positive and negative signs are relative concepts for comparing intensities of the voltages applied to the X and Y electrodes, and applying the positive pulse voltage to the X electrode represents that a voltage greater than the voltage applied to the Y electrode is applied to the X electrode), and a positive voltage pulse is concurrently applied to the M electrode in the start period of the sustain discharge. Therefore, differing from the conventional case in which the discharge occurs between the X electrode and the Y electrode, the discharge occurs between the X electrode/the M electrode and the Y electrode. In particular, the electric field applied between the M and Y electrodes becomes greater since the distance between the M and Y electrodes is shorter than the distance between the X and Y electrodes. Therefore, the discharge between the M and Y electrodes performs a dominant role compared to the discharge between the X and Y electrodes. As described, the discharge between the M and Y electrodes, having a relatively shorter distance, performs the leading role in the earlier sustain discharge, and it is referred to as the short-gap discharge.

Accordingly, when insufficient priming particles are generated within the discharge cells at the time of applying a first sustain discharge pulse after an address period, sufficient discharge is performed since the short-gap discharge which is executed in the earlier sustain discharge stage by applying a relatively high electric field is generated.

(3-2) Long-Gap Discharge Period

Since the voltage at the M electrode is biased with a constant voltage VM after the first sustain discharge pulse of the sustain discharge is applied, the discharge between the M and X electrodes or between the M and Y electrodes (i.e., the short-gap discharge) performs a minor role, the discharge between the X and Y electrodes becomes the major discharge, and the input image is displayed by the number of discharge pulses alternately applied to the X and Y electrodes.

That is, as shown in part (d) of FIG. 9E, the negative wall charges are continuously accumulated at the M electrode, and the negative wall charges and the positive wall charges are alternately accumulated to the X and Y electrodes in the normal sustain discharge period.

Since the discharge is performed by the short-gap discharge between the X and M electrodes (or between the Y and M electrodes) in the earlier sustain discharge stage, sufficient discharge is performed when the priming particles are less, and since the discharge is performed by the long-gap discharge between the X and Y electrodes in the normal state, stable discharge is performed.

Also, since substantially symmetrical voltage waveforms are applied to the X and Y electrodes, the circuits for driving the X and Y electrodes are designed in substantially the same manner. Therefore, since the difference of the circuit impedance between the X and Y electrodes is substantially eliminated, a distortion of the pulse waveforms applied to the X and Y electrodes in the sustain discharge period is reduced, and stable discharge is provided.

According to the first exemplary embodiment shown by FIG. 8, reversed waveforms of the X and Y electrodes can be driven, and also, reversed waveforms of the X and Y electrodes can be driven in the address period.

According to the driving method of the first exemplary embodiment, a reset waveform and a scan pulse waveform are mainly applied to the M electrode, and a sustain discharge voltage waveform is mainly applied to the X and Y electrodes. In this instance, various types of reset waveforms as well as the reset waveform shown in FIG. 8 can be applied to the M electrode.

In this instance, it is desirable to satisfy the following four conditions when applying the various types of reset waveforms to the four-electrode structure according to the exemplary embodiment of the present invention:

First, the voltage waveform Rm(v) applied to the M electrode is to be established to be greater than the voltage waveform Rx(v) applied to the X electrode or the voltage waveform Ry(v) applied to the Y electrode in the rising reset waveform period (Rm(v)>(Rx(v) or Ry(v)).

Second, the voltage waveform Fm(v) applied to the M electrode is to be established to be less than the voltage waveform Fx(v) applied to the X electrode or the voltage waveform Fy(v) applied to the Y electrode in the falling reset waveform period (Fm(v)<(Fx(v) or Fy(v)).

Third, the voltage waveform Am(v) applied to the M electrode is to be established to be less than the voltage waveform Ax(v) applied to the X electrode or the voltage waveform Ay(v) applied to the Y electrode in the address period (Am(v)<(Ax(v) or Ay(v)).

Fourth, the voltage waveform Sm(v) applied to the M electrode is to be established to be greater than the voltage waveform Sx(v) applied to the X electrode or the voltage waveform Sy(v) applied to the Y electrode in the sustain discharge period time (Sm(v)>(Sx(v) or Sy(v)). Also, the voltage waveform Sm(v) applied to the M electrode in the sustain discharge period time is to be greater than the voltage waveform Am(v) applied to the M electrode in the address period (Sm(v)>Am(v)).

Figure 10:
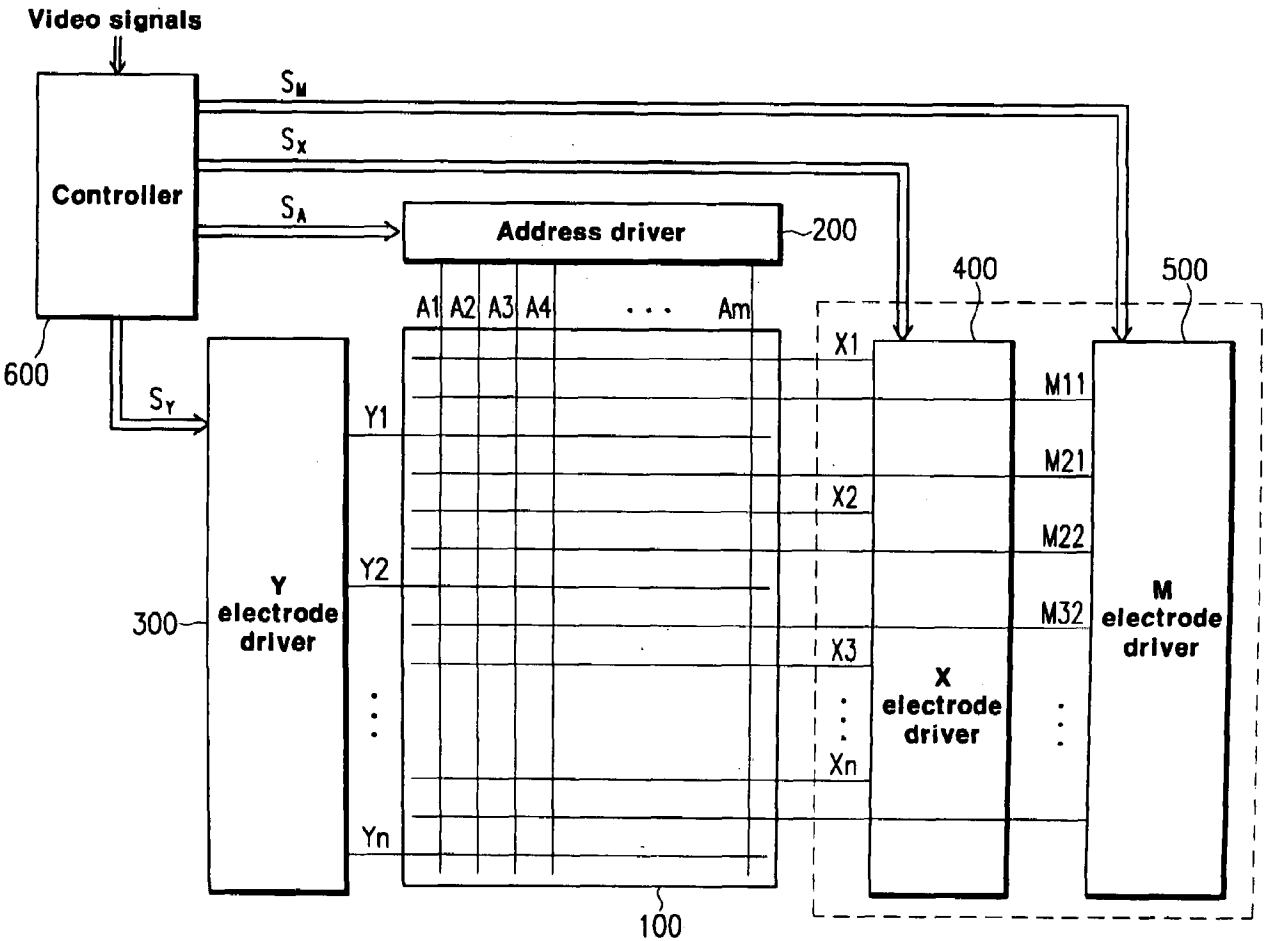
FIG. 10 shows a plasma display according to an exemplary embodiment of the present invention.

FIG. 10 shows a plasma display diagram according to an exemplary embodiment of the present invention. The plasma display includes a plasma display panel 100, an address driver 200, a Y electrode driver 300, an X electrode driver 400, an M electrode driver 500, and a controller 600.

The plasma display panel 100 includes a plurality of address electrodes A1 to Am arranged in a column direction, and a plurality of Y electrodes Y1 to Yn, X electrodes X1 to Xn, and Mij electrodes arranged in the row direction. The Mij electrodes represent electrodes formed between the Yi electrodes and the Xj electrodes.

The address driver 200 receives an address driving control signal $S_A$ from the controller 600, and applies a display data signal for selecting a discharge cell to be displayed to the respective address electrodes.

The Y electrode driver 300 receives a Y electrode driving signal $S_Y$ from the controller 600, and applies the waveform shown in FIG. 8 to the Y electrode.

The X electrode driver 400 receives an X electrode driving signal $S_X$ from the controller 600, and applies the waveform shown in FIG. 8 to the X electrode.

The M electrode driver 500 receives an M electrode driving signal $S_M$ from the controller 600, and applies the corresponding waveform shown in FIG. 8 to the M electrodes.

The controller 600 receives external video signals, generates an address driving control signal $S_A$, a Y electrode driving signal $S_Y$, an X electrode driving signal $S_X$, and an M electrode driving signal $S_M$.

Figure 11:
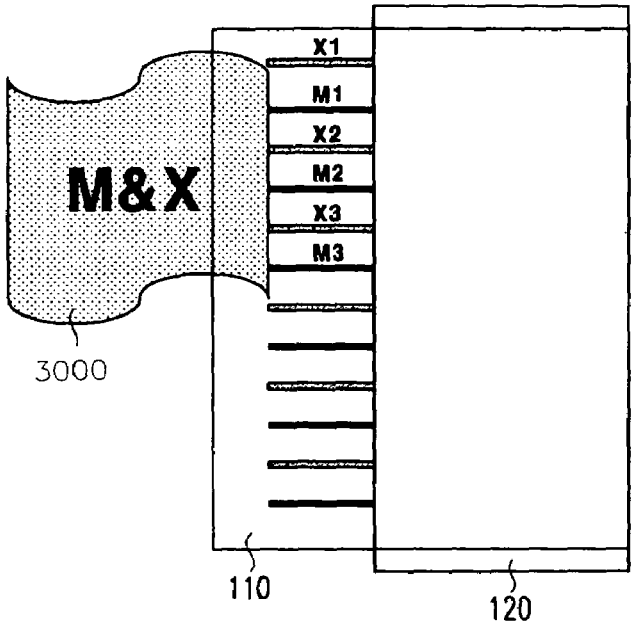
FIG. 11 shows a flexible printed circuit according to a first exemplary embodiment of the present invention.
Figure 12:
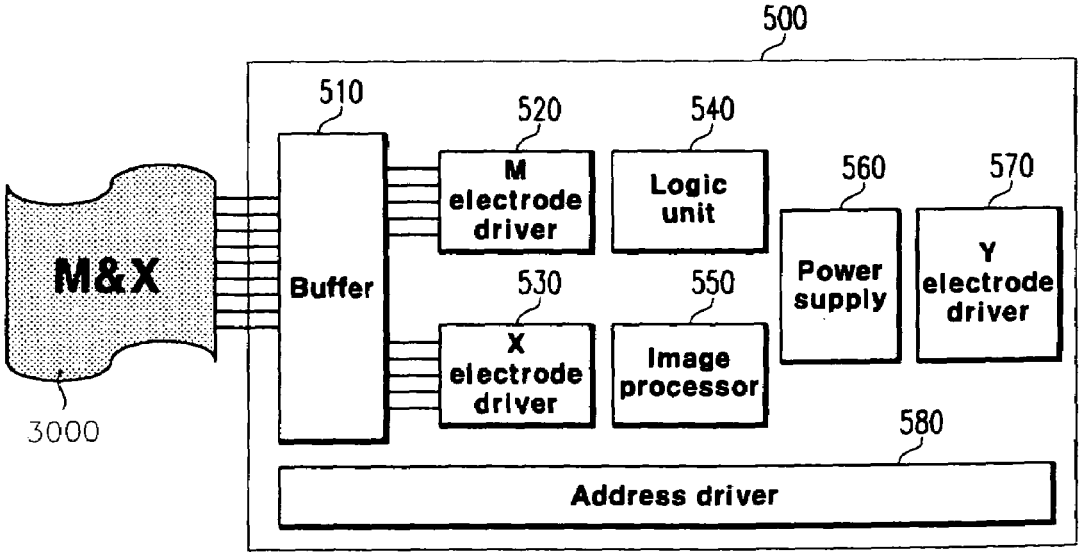
FIG. 12 shows a circuit arrangement diagram of a plasma display according to a first exemplary embodiment of the present invention.

FIG. 11 shows an exemplified flexible printed circuit (FPC) according to a first exemplary embodiment of the present invention, and FIG. 12 shows a circuit arrangement diagram for driving a plasma display according to a first exemplary embodiment of the present invention. X and M electrodes are bonded with a single M&X electrode FPC 3000 in the first exemplary embodiment of the present invention. M&X electrode FPC 3000 is coupled to the X1, X2 . . . and M1, M2 . . . electrodes formed in conjunction with substrates 110 and 120.

As shown in FIG. 12, a buffer 510, an M electrode driver 520, an X electrode driver 530, a logic unit 540, an image processor 550, a power supply 560, a Y electrode driver 570, and an address driver 580 are installed on a chassis 500 according to the first exemplary embodiment.

The buffer 510 coupled to the M&X electrode FPC 300 separates circuit-wise the M and X electrodes. No description on the configuration of the buffer 510 will be provided since it is well known to a person skilled in the art.

Signal lines separated by the buffer 510 are coupled to the M electrode driver 520 and the X electrode driver 530.

The M electrode driver 520, the X electrode driver 530, the Y electrode driver 570, and the address driver 580 are used to apply the driving waveforms shown in FIG. 8. The logic unit 540, the image processor 550, and the power supply 560 are widely used for the plasma display and no corresponding description will be provided since they are well known to a skilled person.

The FPC circuit may be complicated in the first exemplary embodiment since the M and X electrodes are concurrently bonded to the FPC 3000. Also, since two electrodes are bonded through a single FPC, a buffer for separating the two electrodes circuit-wise is required, and hence, the number of drivers needed is increased.

Figure 13:
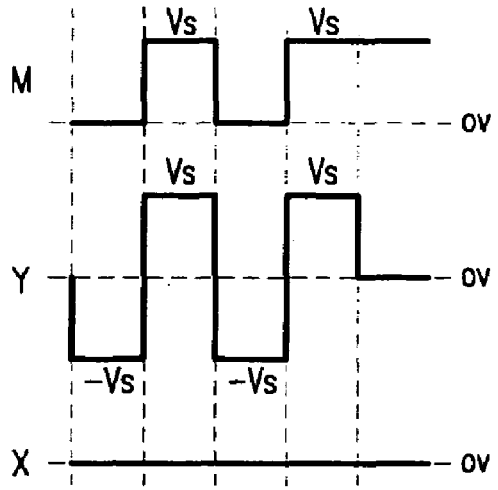
FIGS. 13 and 14 show plasma display driving waveform diagrams according to second and third exemplary embodiments of the present invention.
Figure 14:
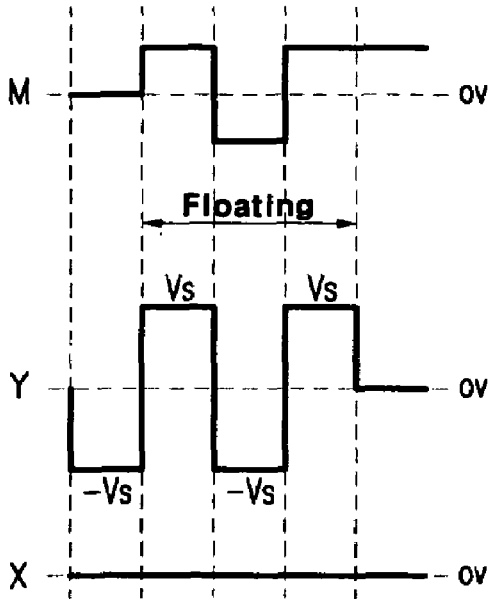

FIGS. 13 and 14 show driving waveform diagrams according to the second and third exemplary embodiments of the present invention. In a sustain discharge period, a ground (0V) voltage and a voltage of Vs are alternately applied to the M electrode while the X electrode is biased with the ground voltage. A voltage of −Vs is applied to the Y electrode while the ground voltage is applied to the M electrode, and the voltage of Vs is applied to the Y electrode while the voltage of Vs is applied to the M electrode.

It is understood that the waveforms of the voltage between the X and Y electrodes, the voltage between the X and M electrodes, and the voltage between the Y and M electrodes would correspond to the waveforms of FIG. 8 in the sustain discharge period when the waveforms of FIG. 13 are applied to the X, Y, and M electrodes. That is, when the waveforms shown in FIG. 13 are applied the sustain discharge process is performed in a like manner as for the waveforms shown in FIG. 8. The case of applying the waveforms shown in FIG. 13 needs no further circuit for driving the Y electrodes since the Y electrodes are biased with the ground voltage.

Referring to FIG. 14, the waveforms of the X and Y electrodes correspond to the waveforms shown in FIG. 13 except that the M electrode is floated in the sustain discharge period.

When the M electrode is floated, the M electrode has the same waveform as the waveform shown in FIG. 13 since a mean voltage value of the X and Y electrodes is maintained. Therefore, the waveforms of the voltage between the X and Y electrodes, the voltage between the X and M electrodes, and the voltage between the Y and M electrodes substantially correspond to the waveforms of FIG. 8 in the sustain discharge period when the waveforms of FIG. 14 are applied to the X, Y, and M electrodes in the sustain discharge period.

Therefore, no additional circuit for driving the Y electrode is needed when applying the waveforms of FIG. 14, and the circuit configuration of the M electrode driver becomes simpler since it is required to float the M electrode in the sustain discharge period.

Figure 15:
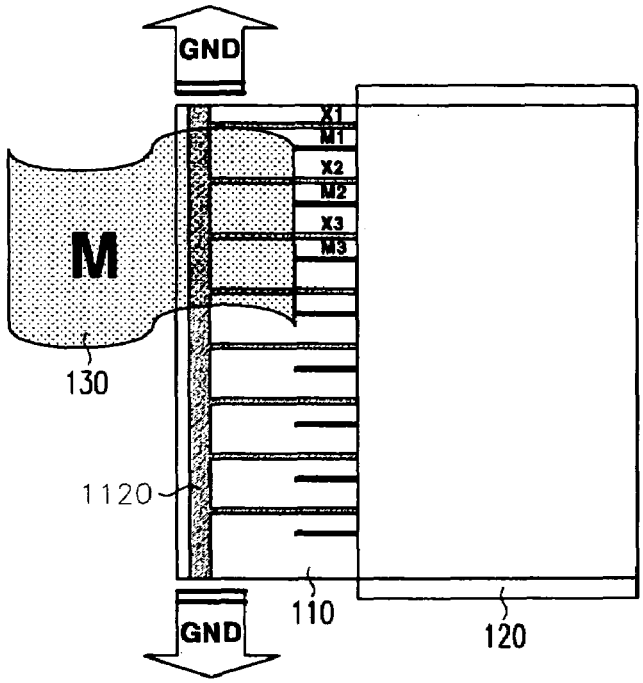
FIG. 15 shows a flexible printed circuit according to second and third exemplary embodiments of the present invention.
Figure 16:
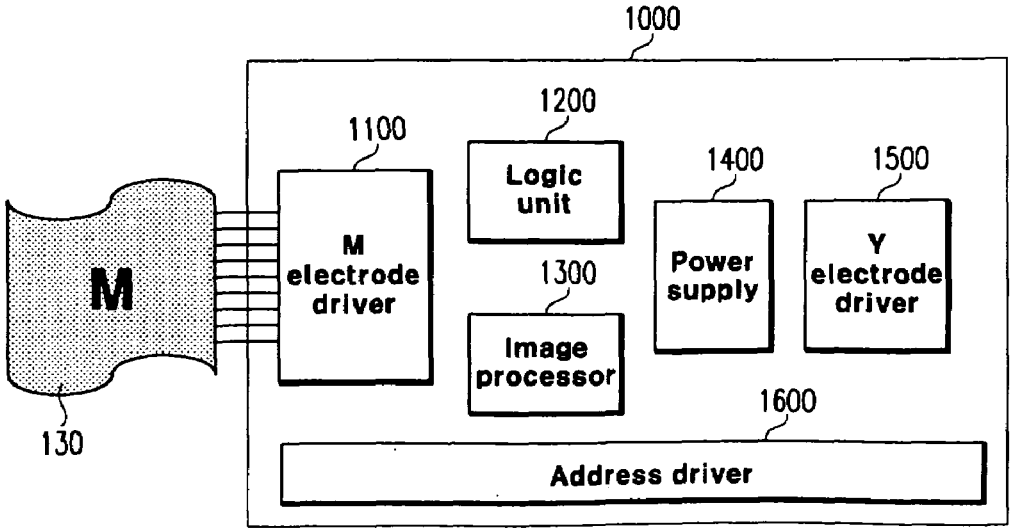
FIG. 16 shows a plasma display circuit arrangement diagram according to second and third exemplary embodiments of the present invention.

FIG. 15 shows an FPC according to the second and third exemplary embodiments of the present invention, and FIG. 16 shows a circuit arrangement diagram of a plasma display according to the second and third exemplary embodiments of the present invention.

Referring to FIG. 15, the M electrodes are bonded to the FPC 130, and the X electrodes are coupled to a common coupling line 1120 on the panel and are grounded. The configuration of the FPC according to the second and third exemplary embodiments is simpler than that of the FPC shown in FIG. 11.

For example, an SD-level plasma display requires an FPC for coupling 720 lines of electrodes including 480-lines M electrodes and 240 lines of X electrodes, which are half the M electrode lines according to the first exemplary embodiment shown in FIG. 11, and the same SD-level plasma display requires an FPC for coupling 480 lines of M electrodes according to the second and third exemplary embodiments shown in FIG. 15, thereby allowing the simpler FPC configuration.

Further, since an HD-level plasma display requires 1,152 lines of electrodes including 768 lines of M electrodes and 384 lines of X electrodes according to the first exemplary embodiment shown in FIG. 11, it is difficult to arrange the FPC for coupling the M and X electrodes on one side of the panel, and accordingly, the FPC is arranged covering both sides of the panel.

However, the FPC can be arranged on one side of the panel in the second and third exemplary embodiments since the HD-level plasma display needs the FPC for coupling 768 lines of M electrodes.

Referring to FIG. 16, an M electrode driver 1100, a Y electrode driver 1500, a logic unit 1200, an image processor 1300, and a power supply are installed on a chassis 1000.

As shown in FIG. 16, no additional driver for driving the X electrodes is needed since the X electrodes are grounded in common, and no further buffer 51 is required as shown in FIG. 12 since the FPC 130 is coupled to the M electrodes, according to the second and third exemplary embodiments.

Figure 17:
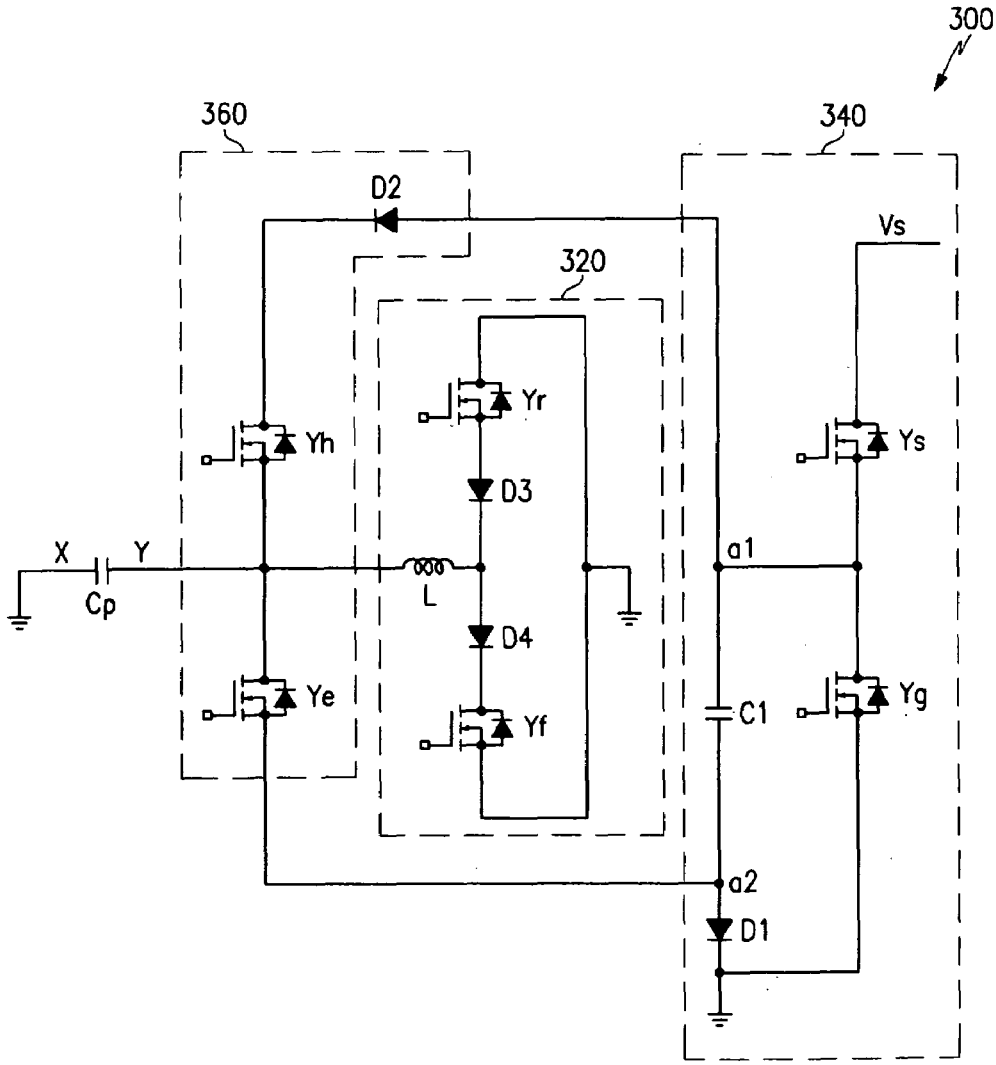
FIG. 17 shows a circuit diagram for driving a Y electrode according to second and third exemplary embodiments of the present invention.

FIG. 17 shows a circuit diagram for driving the Y electrode according to the second and third exemplary embodiments of the present invention.

The Y electrode driving circuit includes a power recovery unit 320, a sustain discharge voltage generator 340, and a sustain discharge voltage supply 360.

The sustain discharge voltage generator 340 includes transistors Ys and Yg coupled in series between the power supply voltage of Vs and the ground voltage, a capacitor C1 having a first terminal a1 coupled to a node between the transistors Ys and Yg, and a diode D1 having an anode and a cathode coupled between a second terminal a2 of the capacitor C1 and the ground voltage.

The sustain discharge voltage generator 340 turns on the transistor Ys and turns off the transistor Yg to charge the capacitor C1 with the voltage of Vs, outputs the voltage of Vs from the first terminal a1 of the capacitor C1, and outputs the voltage of −Vs from the second terminal a2 of the capacitor C1.

In more detail, the sustain discharge voltage generator 340 turns off the transistors Ys and Yg to supply the ground voltage to the second terminal a2 of the capacitor C1 and accordingly outputs the voltage of Vs to the first terminal a1 of the capacitor C1. Also, the sustain discharge voltage generator 340 turns off the transistor Ys and turns on the transistor Yg to supply the ground voltage to the first terminal a1 of the capacitor C1 and accordingly outputs the voltage of −Vs to the second terminal a2 of the capacitor C1.

The sustain discharge voltage supply 360 includes transistors Yh and Ye coupled in series between the first and second terminals a1 and a2 of the capacitor C1, and may further include a diode D2 having an anode and a cathode coupled between the first terminal a1 of the capacitor C1 and the transistor Yh. A node between the transistors Yh and Ye is coupled to the Y electrode of the panel capacitor Cp. In this instance, the panel capacitor equivalently shows capacitance between the X and Y (or M) electrodes.

The sustain discharge voltage supply 360 supplies the voltage of Vs generated by the sustain discharge voltage generator 340 to the Y electrode through the transistor Yh, and supplies the voltage of −Vs generated by the sustain discharge voltage generator 340 to the Y electrode through the transistor Ye.

The power recovery unit 320 comprises an inductor L having a first terminal coupled to the Y electrode of the panel capacitor, and transistors Yr and Yf coupled in parallel between a second terminal of the inductor L and the ground, may further include a diode D3 having an anode and a cathode coupled to the transistor Yr and the second terminal of the inductor L, and a diode D4 having an anode and a cathode coupled to the second terminal of the inductor L and the transistor Yf.

The power recovery unit 320 uses LC resonance to increase the voltage at the Y terminal of the panel capacitor to the voltage of Vs, and decrease the same to the voltage of −Vs. No detailed description on the operation of the power recovery unit 320 will be provided since it is known to a person skilled in the art.

The X electrode has been grounded and the discharge voltage pulses have been applied to the Y electrodes according to the second and third exemplary embodiments, and in addition, the Y electrode can be grounded and the discharge voltage pulses can be applied to the X electrodes.

As described, bad discharges are prevented since the reset process of the first sustain discharge is performed by using the middle electrodes.

Also, the circuit configuration is simplified since the X or Y electrode is grounded to drive the plasma display.

While this invention has been described in connection with what is presently considered to be the practical embodiments, it is to be understood that the invention is not limited to the disclosed embodiments, but, on the contrary, is intended to cover various modifications and equivalent arrangements included within the spirit and scope of the appended claims.

What is claimed is:

1. A method for driving a plasma display having a plurality of first electrodes and second electrodes arranged alternately, and a plurality of third electrodes, each third electrode being formed between a respective first electrode and second electrode, comprising:

coupling the first electrodes through a common coupling line and coupling the third electrodes to a driver through a flexible printed circuit;

in a sustain discharge period, (a) biasing each first electrode with a first voltage through the common coupling line;

(b) alternately applying a second voltage which is greater than the first voltage and a third voltage which is less than the first voltage to each second electrode; and (c) applying a fourth voltage which is greater than the first voltage to each third electrode while the second voltage is applied to each second electrode, and applying a fifth voltage which is less than the first voltage to each third electrode while the third voltage is applied to the second electrode.

2. The method of claim 1, wherein the first voltage is the ground voltage.

3. The method of claim 2, wherein the second voltage and the third voltage have substantially the same size and have opposite polarities.

4. The method of claim 3, wherein the fourth voltage and the fifth voltage are applied to the third electrode by floating the third electrode.

5. The method of claim 2, wherein the second voltage and the fourth voltage have substantially the same voltage level, and the first voltage and the fifth voltage have substantially the same voltage level.

6. The method of claim 5, wherein the fourth voltage and the fifth voltage are applied to the third electrode by floating the third electrode.

7. The method of claim 2, wherein the fourth voltage and the fifth voltage are applied to the third electrode by floating the third electrode.

8. The method of claim 1, wherein the fourth voltage and the fifth voltage are applied to the third electrode by floating the third electrode.

9. A plasma display comprising:

a plasma display panel including a plurality of X electrodes and Y electrodes arranged alternately, and a plurality of M electrodes, each M electrode being formed between a respective X electrode and Y electrode, and a plurality of insulated address electrodes, each address electrode crossing a respective X electrode, Y electrode, and M electrode;

a common coupling line formed on the plasma display panel and coupled to a first voltage, the common coupling line for coupling the X electrodes in common;

a Y electrode driver for applying a waveform for driving the Y electrodes;

an M electrode driver for applying a waveform for driving the M electrodes; and a flexible printed circuit for coupling the M electrode driver and the M electrodes.

10. The plasma display of claim 9, wherein the Y electrode driver alternately applies a second voltage which is greater than the first voltage and a third voltage which is less than the first voltage to the Y electrodes, and the M electrode driver applies a fourth voltage which is greater than the first voltage to the M electrodes while the second voltage is applied to the Y electrodes, and applies a fifth voltage which is less than the first voltage to the third electrodes while the third voltage is applied to the Y electrodes.

11. The plasma display of claim 10, wherein the first voltage is the ground voltage.

12. The plasma display of claim 11, wherein the second voltage and the third voltage have substantially the same size and have opposite polarities.

13. The plasma display of claim 12, wherein the M electrode driver applies the fourth voltage and the fifth voltage to the M electrode by floating the M electrodes.

14. The plasma dispay of claim 11, wherein the M electrode driver applies the fourth voltage and the fifth voltage to the M electrodes by floating the M electrodes.

15. The plasma display of claim 10, wherein the M electrode driver applies the fourth voltage and the fifth voltage to the M electrodes by floating the M electrodes.

* * * * *

UNITED STATES PATENT AND TRADEMARK OFFICE

CERTIFICATE OF CORRECTION

PATENT NO. : 7,212,176 B2
APPLICATION NO. : 11/046636
DATED : May 1, 2007
INVENTOR(S) : Kim

It is certified that error appears in the above-identified patent and that said Letters Patent is hereby corrected as shown below:

| | |
|---|---|
| Column 12, line 36, Claim 14 | Delete “dispay”,<br>Insert --display-- |

Signed and Sealed this

Sixteenth Day of October, 2007

JON W. DUDAS
*Director of the United States Patent and Trademark Office*